US011913085B1

(12) United States Patent
Chai et al.

(10) Patent No.: US 11,913,085 B1
(45) Date of Patent: Feb. 27, 2024

(54) METHODS FOR PREPARING HIGH PERFORMANCE PRESS-HARDENED STEEL COMPONENTS

(71) Applicants: GM GLOBAL TECHNOLOGY OPERATIONS LLC, Detroit, MI (US); NORTHEASTERN UNIVERSITY, Shenyang (CN)

(72) Inventors: Zhisong Chai, Shanghai (CN); Tingdong Ren, Shanghai (CN); Jinlong Zhu, Shanghai (CN); Wei Xu, Shenyang (CN); Jianfeng Wang, Shanghai (CN)

(73) Assignees: GM Global Technology Operations LLC, Detroit, MI (US); Northeastern University, Shenyang (CN)

( * ) Notice: Subject to any disclaimer, the term of this patent is extended or adjusted under 35 U.S.C. 154(b) by 0 days.

(21) Appl. No.: 17/965,312

(22) Filed: Oct. 13, 2022

(30) Foreign Application Priority Data

Aug. 8, 2022 (CN) ..... 202210944339.1

(51) Int. Cl.
*C21D 1/673* (2006.01)
*B21D 22/02* (2006.01)
(Continued)

(52) U.S. Cl.
CPC ..... *C21D 1/673* (2013.01); *B21D 22/022* (2013.01); *C21D 1/18* (2013.01); *C22C 38/02* (2013.01);
(Continued)

(58) Field of Classification Search
None
See application file for complete search history.

(56) References Cited

U.S. PATENT DOCUMENTS 10,260,121 B2 4/2019 Lu et al.
11,255,006 B2 2/2022 Lu et al.
(Continued)

FOREIGN PATENT DOCUMENTS

DE 10256621 B3 4/2004
DE 102007012180 B3 6/2008
(Continued)

OTHER PUBLICATIONS

Paul J. Belanger et al.; "Material Testing and Process Control Requirements for Press Hardened Steel Suppliers"; Feb. 20, 2013; 9 pages.
(Continued)

*Primary Examiner* — Anthony M Liang
(74) *Attorney, Agent, or Firm* — Harness, Dickey & Pierce, P.L.C.

(57) ABSTRACT

A method for preparing a press-hardened steel component is provided. The method includes forming a heated blank by heating a steel alloy blank to a first temperature in a first zone of a furnace having two or more zones, and after the heating of the steel alloy blank to the first temperature, heating the steel alloy blank to a second temperature in a second zone of the furnace. The second temperature is greater than the first temperature. The first zone has a first flow rate for a protective gas, and the second zone has a second flow rate for the protective gas that is greater than the first flow rate. The method further includes stamping and quenching the heated blank at a constant rate to a temperature between a martensite finish temperature of the steel alloy defining the steel alloy blank and room temperature to form the press-hardened steel component.

20 Claims, 3 Drawing Sheets

Figure 1:
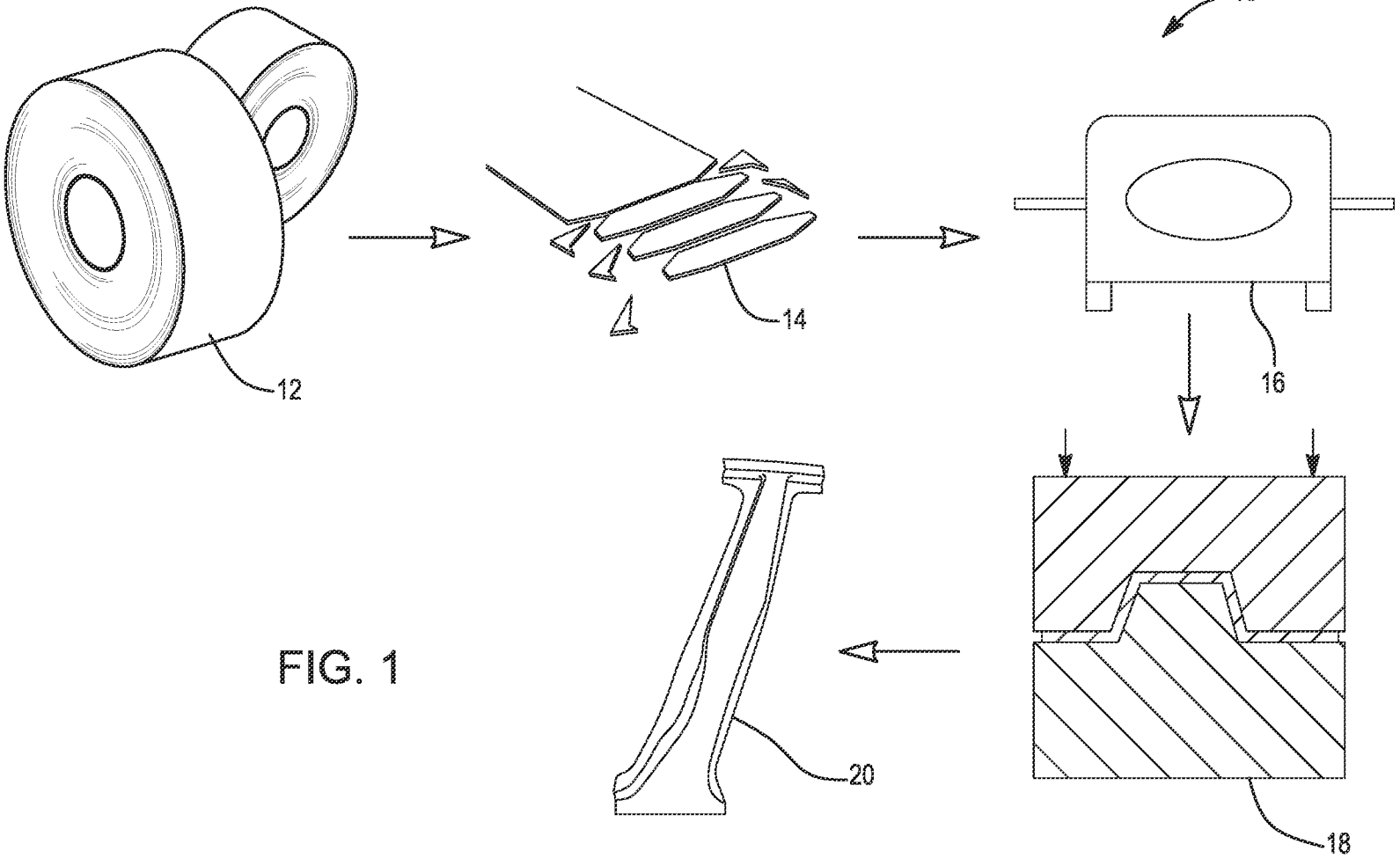

(51) Int. Cl.

| | |
|---|---|
| ***C21D 1/18*** | (2006.01) |
| ***C22C 38/02*** | (2006.01) |
| ***C22C 38/04*** | (2006.01) |
| ***C22C 38/18*** | (2006.01) |

(52) U.S. Cl.
CPC ..... *C22C 38/04* (2013.01); *C22C 38/18* (2013.01); *C21D 2211/001* (2013.01); *C21D 2211/008* (2013.01)

(56) References Cited

U.S. PATENT DOCUMENTS

| | | | | |
|---|---|---|---|---|
| 11,400,690 | B2 | 8/2022 | Lu et al. | |
| 11,415,040 | B1 | 8/2022 | Smith et al. | |
| 11,530,469 | B2 | 12/2022 | Lu et al. | |
| 2018/0147614 | A1* | 5/2018 | Roubidoux | C21D 6/002 |
| 2020/0190611 | A1 | 6/2020 | Lu et al. | |
| 2021/0087661 | A1 | 3/2021 | Lu et al. | |
| 2021/0189531 | A1 | 6/2021 | Lu et al. | |
| 2021/0198760 | A1 | 7/2021 | Lu et al. | |
| 2021/0222265 | A1 | 7/2021 | Lu et al. | |
| 2021/0276065 | A1 | 9/2021 | Pang et al. | |
| 2022/0356540 | A1 | 11/2022 | Lu et al. | |
| 2023/0140215 | A1 | 5/2023 | Lu et al. | |

FOREIGN PATENT DOCUMENTS

| | | | | |
|---|---|---|---|---|
| DE | 102013009232 | A1 | 12/2014 | |
| DE | 102013107870 | A1 * | 1/2015 | C21D 1/673 |
| DE | 102020134324 | A1 | 7/2021 | |
| WO | WO-2016106621 | A1 | 7/2016 | |
| WO | WO-2020165116 | A1 * | 8/2020 | C21D 1/18 |

OTHER PUBLICATIONS

H. Karbasian et al.; "A Review on Hot Stamping"; Journal of Materials Processing Technology 210; Jul. 19, 2010; pp. 2103-2118.
Qi Lu et al.; U.S. Appl. No. 17/740,472, filed May 10, 2022; titled "Methods to Improve the Toughness of Press Hardening Steel"; 50 pages.
First Office Action for German Patent Application No. 10 2022 122 051.6 dated Apr. 17, 2023, with correspondence from Manitz Finsterwald Patent- und Rechtsanwaltspartnerschaft mbB summarizing Office Action; 6 pages.

* cited by examiner

METHODS FOR PREPARING HIGH PERFORMANCE PRESS-HARDENED STEEL COMPONENTS

CROSS-REFERENCE TO RELATED APPLICATIONS

This application claims the benefit of Chinese Patent Application No. 202210944339.1 filed on Aug. 8, 2022. The entire disclosure of the application referenced above is incorporated herein by reference.

INTRODUCTION

This section provides background information related to the present disclosure which is not necessarily prior art.

Press-hardening steel (PHS), also referred to as "hot-stamped steel" or "hot-formed steel," is one of the strongest steels used for automotive body structural applications. For example, in certain applications, press-hardening steel may have tensile strength properties of about 1,500 megapascal (MPa) and significant increases in strength-to-weight ratios. Press-hardening steel components have become ever more prevalent in various industries and applications, including general manufacturing, construction equipment, automotive or other transportation industries, home or industrial structures, and the like. For example, continual improvements in fuel efficiency and performance are desirable when manufacturing vehicles, especially automobiles. As such, press-hardening steel components are increasingly used in the automotive or other transportation industries. For example, press-hardening steel components are often used for forming load-bearing components, like door beams, which usually require high strength materials. These press-hardening steel components high strength and enough ductility to resist external forces, including, for example, resisting intrusion into a passenger compartment.

Many processes for forming press-hardening steel components include the austenitization of a sheet steel blank using a furnace. For example, austenitization may occur at temperatures greater than or equal to about 880° C. to less than or equal to about 950° C. The austenitization is often followed by pressing and quenching of the sheet steel using dies. For example, in direct processes, the press-hardening steel components may be formed and pressed simultaneously between dies that are also configured to quench the steel sheet. In the instance of indirect processes, the press-hardening steel components may be cold-formed to form an intermediate partial shape that is then subject to austenitization and subsequently pressing and quenching. In each instance, the quenching of the press-hardening steel components often transforms microstructures from austenite to martensite, and the quenching includes using differential cooling to adjust the strength and elongation properties of the press-hardening steel components. For example, cooling rates above 27 K/s in a boron-manganese steel (e.g., 22MnB5) often leads to the formation of a martensitic structure, while lower cooling rates force the formation of a more ductile microstructure with lower strength, such as bainite and ferrite-pearlite. Accordingly, it would be desirable to develop steel compositions, and also, methods of making press-hardening steel components, that can improve strength, ductility, and fracture resistance (i.e., toughness).

SUMMARY

This section provides a general summary of the disclosure, and is not a comprehensive disclosure of its full scope or all of its features.

The present technology relates to press hardening steels, and also to methods of forming press-hardening or high-strength steel components from the press hardening steels, without the use of pre-applied coatings for oxidation avoidance during hot stamping, and also, descaling operations post-forming processes are not required.

In various aspects, the present disclosure provides a method for preparing a press-hardened steel component. The method may include austenitizing a steel alloy blank to form a heated blank using a furnace having two or more zones. A first zone of the two or more zones may have a first temperature and a first flow rate for a protective gas. A second zone of the two or more zones may have a second temperature that is greater than the first temperature and a second flow rate for the protective gas that is greater than the first flow rate. The method may further include stamping the heated blank to form a predetermined shape that defines the press-hardened steel component.

In one aspect, the first temperature may be greater than or equal to about 700° C. to less than or equal to about 910° C., and the second temperature may be greater than or equal to about 760° C. to less than or equal to about 950° C.

In one aspect, the first flow rate may be greater than or equal to about 30 $m^3$/h to less than or equal to about 50 $m^3$/hour, and the second flow rate may be greater than or equal to about 50 m/hour to less than or equal to about 160 $m^3$/hour.

In one aspect, a first heating rate in the first zone may be greater than or equal to about 10° C./second to less than or equal to about 30° C./second, and a second heating rate in the second zone may be greater than or equal to about 0° C./second to less than or equal to about 10° C./second.

In one aspect, the steel alloy blank may be held in the first zone for a period greater than or equal to about 39 seconds to less than or equal to about 164 seconds.

In one aspect, the protective gas may be a nitrogen-containing gas.

In one aspect, the steel alloy blank may include greater than or equal to about 0.05 wt. % to less than or equal to about 0.45 wt. % of carbon (C), greater than or equal to about 0.5 wt. % to less than or equal to about 6 wt. % of chromium (Cr), greater than or equal to about 0.5 wt. % to less than or equal to about 2.5 wt. % of silicon (Si), and a balance of iron.

In one aspect, the steel alloy blank may further include greater than 0 wt. % to less than or equal to about 4.5 wt. % of manganese (Mn).

In one aspect, the steel alloy blank may further include at least one of: greater than 0 wt. % to less than or equal to about 5 wt. % of nickel (Ni), greater than 0 wt. % to less than or equal to about 3 wt. % of copper (Cu), greater than 0 wt. % to less than or equal to about 1 wt. % of molybdenum (Mo), greater than 0 wt. % to less than or equal to about 1 wt. % of vanadium (V), and greater than 0 wt. % to less than or equal to about 0.5 wt. % of niobium (Nb).

In one aspect, the stamping may include quenching the heated blank at a constant rate to a temperature less than or equal to about a martensite finish (Mf) temperature of the steel alloy defining the steel alloy blank and greater than or equal to about 20° C.

In various aspects, the present disclosure provides a method for preparing a press-hardened steel component. The method may include forming a heated blank. The heated blank may be formed by heating a steel alloy blank to a first temperature in a first zone of a furnace having two or more zones, and after the heating of the steel alloy blank to the first temperature, heating the steel alloy blank to a second temperature in a second zone of the furnace. The first zone may have a first flow rate for a protective gas. The second temperature may be greater than the first temperature. The second zone may have a second flow rate for the protective gas that is greater than the first flow rate. The method may further include stamping and quenching the heated blank at a constant rate to a temperature less than or equal to about a martensite finish (Mf) temperature of the steel alloy defining the steel alloy blank and greater than or equal to about 20° C. to form the press-hardened steel component.

In one aspect, the first temperature may be greater than or equal to about 700° C. to less than or equal to about 910° C., the second temperature may be greater than or equal to about 760° C. to less than or equal to about 950° C., the first flow rate may be greater than or equal to about 30 $m^3$/hour to less than or equal to about 50 $m^3$/hour, and the second flow rate may be greater than or equal to about 50 $m^3$/hour to less than or equal to about 160 $m^3$/hour.

In one aspect, the method may further include after heating the steel alloy blank to the first temperature, and before heating the steel alloy blank to the second temperature, heating the steel alloy blank to a third temperature in a third zone of the furnace. The third zone may be disposed between the first zone and the second zone. The third temperature may be greater than the first temperature and less than the second temperature. The third zone may have a third flow rate for the protective gas that is equal to the first flow rate.

In one aspect, the first temperature may be greater than or equal to about 700° C. to less than about 800° C., the third temperature may be greater than about 800° C. to less than or equal to about 850° C., and the second temperature may be greater than or equal to about 850° C. to less than or equal to about 910° C.

In one aspect, a first heating rate in the first zone may be greater than or equal to about 10° C./second to less than or equal to about 30° C./second, a third heating rate in the third zone may be greater than or equal to about 10° C./second to less than or equal to about 30° C./second, and a second heating rate in the second zone may be greater than or equal to about 3° C./second to less than or equal to about 20° C./second.

In one aspect, the method may further include after heating the steel alloy blank to the third temperature, and before heating the steel alloy blank to the second temperature, heating the steel alloy blank to a fourth temperature in a fourth zone of the furnace. The fourth zone may be disposed between the third zone and the second zone. The fourth temperature may be greater than the third temperature and less than the second temperature. The fourth zone may have a fourth flow rate for the protective gas that is equal to the first flow rate.

In one aspect, the fourth temperature may be greater than about 910° C. to less than or equal to about 930° C.

In one aspect, a fourth heating rate in the fourth zone may be greater than or equal to about 1° C./second to less than or equal to about 20° C./second.

In one aspect, the steel alloy blank may include greater than or equal to about 0.05 wt. % to less than or equal to about 0.45 wt. % of carbon (C), greater than or equal to about 0.5 wt. % to less than or equal to about 6 wt. % of chromium (Cr), greater than or equal to about 0.5 wt. % to less than or equal to about 2.5 wt. % of silicon (Si), greater than 0 wt % to less than or equal to about 4.5 wt. % of manganese (Mn), and a balance of iron.

In various aspects, the present disclosure provides a method for preparing a press-hardened steel component. The method may include heating a steel alloy blank to a first temperature greater than or equal to about 700° C. to less than about 800° C. in a first zone of a furnace, heating the steel alloy blank to a second temperature greater than about 800° C. to less than or equal to about 850° C. in a second zone of the furnace, heating the steel alloy blank to a third temperature greater than or equal to about 850° C. to less than or equal to about 880° C., and heating the steel alloy blank to a fourth temperature greater than or equal to about 910° C. to less than or equal to about 930° C. The first zone may have a first flow rate for a protective gas. The second zone may have a second flow rate for the protective gas. The third zone may have a third flow rate for the protective gas. The fourth zone may have a fourth flow rate for the protective gas. The fourth flow rate may be greater than the first flow rate, the second flow rate, and the third flow rate. The first flow rate, the second flow rate, and the third flow rate may be the same or different. The method may further include after the heating of the steel alloy blank to the fourth temperature, stamping the heated blank to form a predetermined shape that defines the press-hardened steel component.

In one aspect, the stamping may include quenching the heated steel alloy blank at a constant rate to a temperature less than or equal to about a martensite finish (Mf) temperature of the steel alloy defining the steel alloy blank and greater than or equal to about 20° C.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
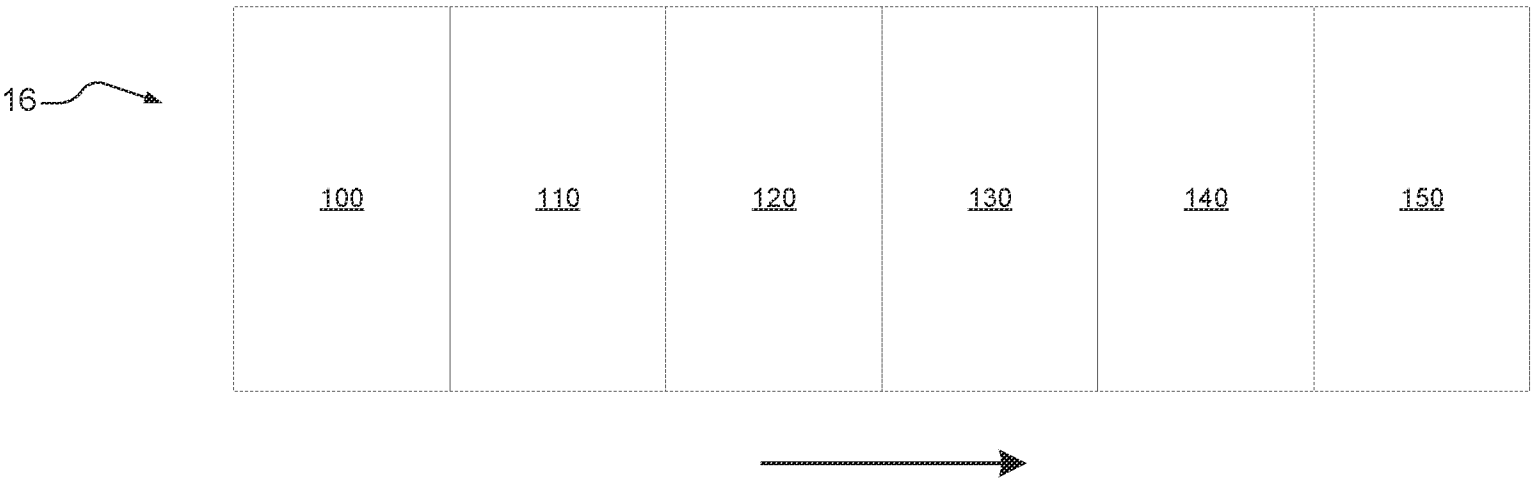
Figure 3:
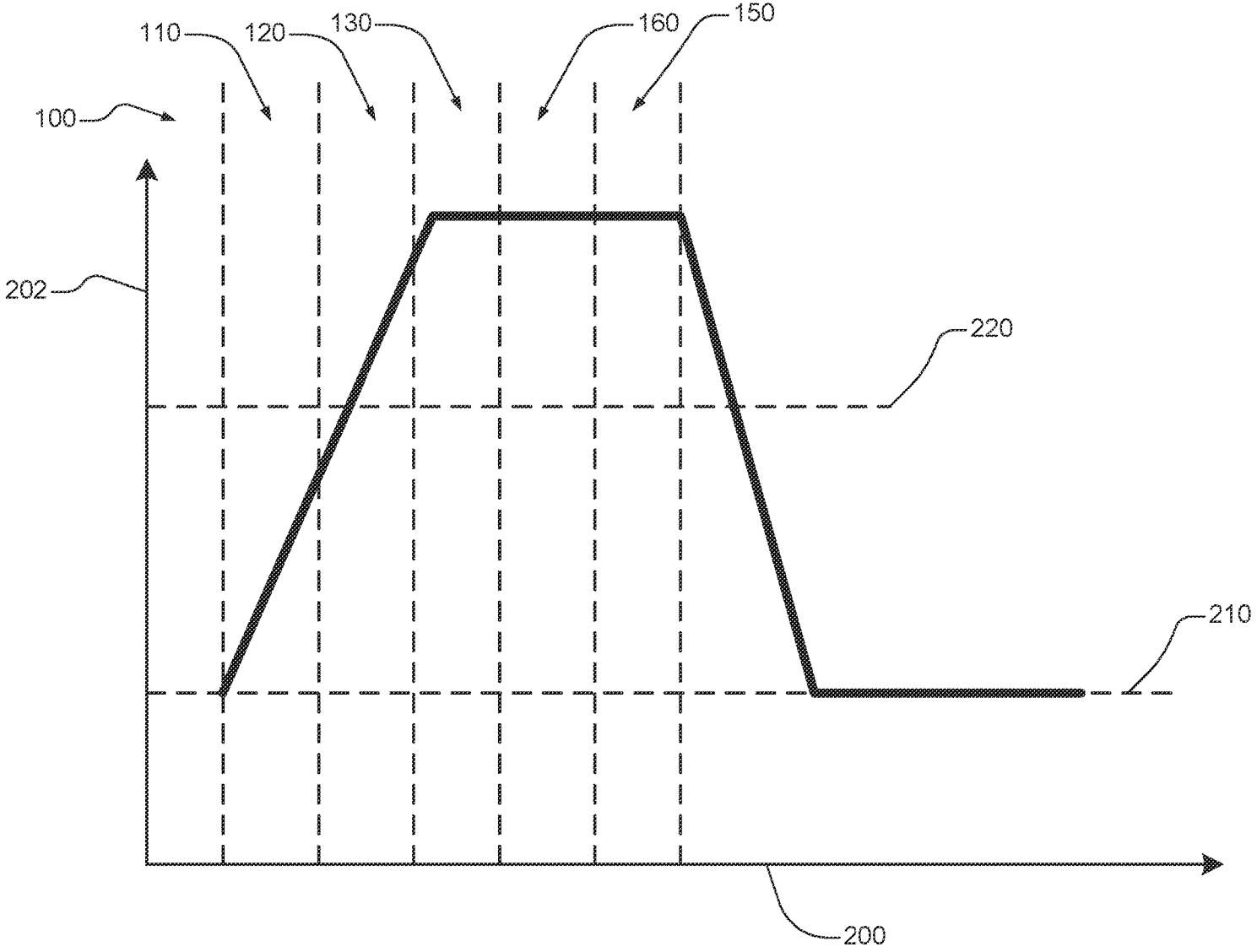

FIG. 1 is a flow diagram illustrating a method of preparing press-hardened steel components in accordance with various aspects of the present disclosure:

FIG. 2 is a schematic illustrating the examples austenitizing zones to be used during the preparation of press-hardened steel components in accordance with various aspects of the present disclosure; and FIG. 3 is a graphical illustrating demonstrating an example temperature profile during the preparation of press-hardened steel components in accordance with various aspects of the present disclosure.

Corresponding reference numerals indicate corresponding parts throughout the several views of the drawings.

DETAILED DESCRIPTION

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected, or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer, or section. Terms such as "first," "second," and other numerical terms when used herein do not imply a sequence or order unless clearly indicated by the context. Thus, a first step, element, component, region, layer, or section discussed below could be termed a second step, element, component, region, layer, or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates both exactly or precisely the stated numerical value, and also, that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

Example embodiments will now be described more fully with reference to the accompanying drawing.

The present technology relates to press hardening steels, and also to methods of forming press-hardening or high-strength steel components from the press hardening steels, without the use of pre-applied coatings for oxidation avoidance during hot stamping, and also, descaling operations post-forming processes are not required. Press hardening steels are those having ultimate tensile strengths greater than or equal to exactly or about 1,000 megapascals (MPa). For example, in certain variations, a press hardening steel may have an ultimate tensile strength greater than or equal to exactly or about 1,400 MPa to less than or equal to exactly or about 2,200 MPa. High strength steel components can be incorporated into various devices. For example, high strength steel components may be particularly suitable for use in components of an automobile or other vehicles (e.g., motorcycles, boats, tractors, buses, motorcycles, mobile homes, campers, and tanks), as well as in components for various other industries and applications, including aerospace components, consumer goods, devices, buildings (e.g., houses, offices, sheds, warehouses), office equipment and furniture, and industrial equipment machinery, agricultural or farm equipment, or heavy machinery, by way of non-limiting example. In certain variations, high strength steel components may be used in the formation of hoods, pillars (e.g., A-pillars, hinge pillars, B-pillars, C-pillars, and the like), panels, including structural panels, door panels, and door components, interior floors, floor pans, roofs, exterior surfaces, underbody shields, wheels, control arms and other suspension, crush cans, bumpers, structural rails and frames, cross car beams, undercarriage or drive train components, and the like.

In various aspects, the press hardening steels are defined by steel alloys including, for example, carbon (C), chromium (Cr), silicon (Si), and iron (Fe). In certain variations, the press hardening steel alloys may also include manganese (Mn). In still further variations, the press hardening steel alloys may include nickel (Ni), copper (Cu), molybdenum (Mo), vanadium (V), and/or niobium (Nb).

In certain variations, the press hardening steel alloys may include greater than or equal to about 0.05 wt. % to less than or equal to about 0.45 wt. % of carbon. For example, the press hardening steel alloys may include greater than or equal to about 0.05 wt. %, optionally greater than or equal to about 0.1 wt. %, optionally greater than or equal to about 0.15 wt. %, optionally greater than or equal to about 0.2 wt. %, optionally greater than or equal to about 0.25 wt. %, optionally greater than or equal to about 0.3 wt. %, optionally greater than or equal to about 0.35 wt. %, and in certain aspects, optionally greater than or equal to about 0.4 wt. %, of carbon. The press hardening steel alloys may include less than or equal to about 0.45 wt. %, optionally less than or equal to about 0.4 wt. %, optionally less than or equal to about 0.35 wt. %, optionally less than or equal to about 0.3 wt. %, optionally less than or equal to about 0.25 wt. %, optionally less than or equal to about 0.2 wt. %, optionally less than or equal to about 0.15 wt. %, and in certain aspects, optionally less than or equal to about 0.1 wt. %, of carbon.

In certain variations, the press hardening steel alloys may include greater than or equal to about 0.5 wt. % to less than or equal to about 6 wt. % of chromium. For example, the press hardening steel alloys may include greater than or equal to about 0.5 wt. %, optionally greater than or equal to about 1 wt. %, optionally greater than or equal to about 1.5 wt. %, optionally greater than or equal to about 2 wt. %, optionally greater than or equal to about 2.5 wt. %, optionally greater than or equal to about 3 wt. %, optionally greater than or equal to about 3.5 wt. %, optionally greater than or equal to about 4 wt. %, optionally greater than or equal to about 4.5 wt. %, optionally greater than or equal to about 5 wt. %, and in certain aspects, optionally greater than or equal to about 5.5 wt. %, of chromium. The press hardening steel alloys may include less than or equal to about 6 wt. %, optionally less than or equal to about 5.5 wt. %, optionally less than or equal to about 5 wt. %, optionally less than or equal to about 4.5 wt. %, optionally less than or equal to about 4 wt. %, optionally less than or equal to about 3.5 wt. %, optionally less than or equal to about 3 wt. %, optionally less than or equal to about 2.5 wt. %, optionally less than or equal to about 2 wt. %, optionally less than or equal to about 1.5 wt. %, and in certain aspects, optionally less than or equal to about 1 wt. %, of chromium.

In certain variations, the press hardening steel alloys may include greater than or equal to about 0.5 wt. % to less than or equal to about 2.5 wt. % of silicon. For example, the press hardening steel alloys may include greater than or equal to about 0.5 wt. %, optionally greater than or equal to about 0.75 wt. %, optionally greater than or equal to about 1 wt. %, optionally greater than or equal to about 1.25 wt. %, optionally greater than or equal to about 1.50 wt. %, optionally greater than or equal to about 1.75 wt. %, optionally greater than or equal to about 2 wt. %, and in certain aspects, optionally greater than or equal to about 2.25 wt. %, of silicon. The press hardening steel alloys may include less than or equal to about 2.5 wt. %, optionally less than or equal to about 2.25 wt. %, optionally less than or equal to about 2 wt. %, optionally less than or equal to about 1.75 wt. %, optionally less than or equal to about 1.5 wt. %, optionally less than or equal to about 1.25 wt. %, optionally less than or equal to about 1 wt. %, and in certain aspects, optionally less than or equal to about 0.75 wt. %, of silicon.

In certain variations, the press hardening steel alloys may include greater than or equal to about 0 wt. % to less than or equal to about 4.5 wt % of manganese. For example, the press hardening steel alloys may include greater than or equal to about 0 wt. %, optionally greater than or equal to about 0.5 wt. %, optionally greater than or equal to about 1 wt. %, optionally greater than or equal to about 1.5 wt %, optionally greater than or equal to about 2 wt. %, optionally greater than or equal to about 2.5 wt %, optionally greater than or equal to about 3 wt. %, optionally greater than or equal to about 3.5 wt. %, and in certain aspects, optionally greater than or equal to about 4 wt %, of manganese. The press hardening steel alloys may include less than or equal to about 4.5 wt. %, optionally less than or equal to about 4 wt. %, optionally less than or equal to about 3.5 wt. %, optionally less than or equal to about 3 wt. %, optionally less than or equal to about 2.5 wt. %, optionally less than or equal to about 2 wt. %, optionally less than or equal to about 1.5 wt. %, optionally less than or equal to about 1 wt. %, and in certain aspects, optionally less than or equal to about 0.5 wt. %, of manganese.

In certain variations, the press hardening steel alloys may include greater than or equal to about 0 wt. % to less than or equal to about 5 wt. % of nickel. For example, the press hardening steel alloys may include greater than or equal to about 0 wt. %, optionally greater than or equal to about 0.5 wt. %, optionally greater than or equal to about 1 wt. %, optionally greater than or equal to about 1.5 wt. %, optionally greater than or equal to about 2 wt. %, optionally greater than or equal to about 2.5 wt. %, optionally greater than or equal to about 3 wt. %, optionally greater than or equal to about 3.5 wt. %, optionally greater than or equal to about 4 wt. %, and in certain aspects, optionally greater than or equal to about 4.5 wt. %, of nickel. The press hardening steel alloys may include less than or equal to about 5 wt. %, optionally less than or equal to about 4.5 wt. %, optionally less than or equal to about 4 wt. %, optionally less than or equal to about 3.5 wt. %, optionally less than or equal to about 3 wt. %, optionally less than or equal to about 2.5 wt. %, optionally less than or equal to about 2 wt. %, optionally less than or equal to about 1.5 wt. %, optionally less than or equal to about 1 wt. %, and in certain aspects, optionally less than or equal to about 0.5 wt. %, of nickel.

In certain variations, the press hardening steel alloys may include greater than or equal to about 0 wt. % to less than or equal to about 3 wt. % of copper. For example, the press hardening steel alloys may include greater than or equal to about 0 wt. %, optionally greater than or equal to about 0.2 wt. %, optionally greater than or equal to about 0.4 wt. %, optionally greater than or equal to about 0.6 wt. %, optionally greater than or equal to about 0.8 wt. %, optionally greater than or equal to about 1 wt. %, optionally greater than or equal to about 1.2 wt. %, optionally greater than or equal to about 1.4 wt. %, optionally greater than or equal to about 1.6 wt. %, optionally greater than or equal to about 1.8 wt. %, optionally greater than or equal to about 2 wt. %, optionally greater than or equal to about 2.2 wt. %, optionally greater than or equal to about 2.4 wt. %, optionally greater than or equal to about 2.6 wt. %, and in certain aspects, optionally greater than or equal to about 2.8 wt. %, of copper. The press hardening steel alloys may include less than or equal to about 3 wt. %, optionally less than or equal to about 2.8 wt. %, optionally less than or equal to about 2.6 wt. %, optionally less than or equal to about 2.4 wt. %, optionally less than or equal to about 2.2 wt. %, optionally less than or equal to about 2 wt. %, optionally less than or equal to about 1.8 wt. %, optionally less than or equal to about 1.6 wt %, optionally less than or equal to about 1.4 wt. %, optionally less than or equal to about 1.2 wt. %, optionally less than or equal to about 1 wt. %, optionally less than or equal to about 0.8 wt. %, optionally less than or equal to about 0.6 wt. %, optionally less than or equal to about 0.4 wt. %, and in certain aspects, optionally less than or equal to about 0.2 wt. %, of copper.

In certain variations, the press hardening steel alloys may include greater than or equal to about 0 wt. % to less than or equal to about 1 wt. % of molybdenum. For example, the press hardening steel alloys may include greater than or equal to 0 wt. %, optionally greater than or equal to 0.05 wt. %, optionally greater than or equal to 0.1 wt. %, optionally greater than or equal to 0.15 wt. %, optionally greater than or equal to 0.2 wt. %, optionally greater than or equal to 0.25 wt. %, optionally greater than or equal to 0.3 wt. %, optionally greater than or equal to 0.35 wt. %, optionally greater than or equal to 0.4 wt. %, optionally greater than or equal to 0.45 wt. %, optionally greater than or equal to 0.5 wt. %, optionally greater than or equal to 0.55 wt. %, optionally greater than or equal to 0.6 wt. %, optionally greater than or equal to 0.65 wt. %, optionally greater than or equal to 0.7 wt. %, optionally greater than or equal to 0.75 wt. %, optionally greater than or equal to 0.8 wt %, optionally greater than or equal to 0.85 wt. %, optionally greater than or equal to 0.9 wt. %, and in certain aspects, optionally greater than or equal to 0.95 wt. %, of molybdenum. The press hardening steel alloy may include less than or equal to about 1 wt. %, optionally less than or equal to about 0.95 wt. %, optionally less than or equal to about 0.9 wt. %, optionally less than or equal to about 0.85 wt. %, optionally less than or equal to about 0.8 wt. %, optionally less than or equal to about 0.75 wt. %, optionally less than or equal to about 0.7 wt. %, optionally less than or equal to about 0.65 wt. %, optionally less than or equal to about 0.6 wt. %, optionally less than or equal to about 0.55 wt. %, optionally less than or equal to about 0.5 wt. %, optionally less than or equal to about 0.45 wt. %, optionally less than or equal to about 0.4 wt. %, optionally less than or equal to about 0.35 wt. %, optionally less than or equal to about 0.3 wt. %, optionally less than or equal to about 0.25 wt. %, optionally less than or equal to about 0.2 wt. %, optionally less than or equal to about 0.15 wt. %, optionally less than or equal to about 0.1 wt. %, and in certain aspects, optionally less than or equal to about 0.05 wt. %, of molybdenum.

In certain variations, the press hardening steel alloys may include greater than or equal to about 0 wt. % to less than or equal to about 1 wt. % of vanadium. For example, the press hardening steel alloys may include greater than or equal to 0 wt. %, optionally greater than or equal to 0.05 wt. %, optionally greater than or equal to 0.1 wt. %, optionally greater than or equal to 0.15 wt. %, optionally greater than or equal to 0.2 wt. %, optionally greater than or equal to 0.25 wt. %, optionally greater than or equal to 0.3 wt. %, optionally greater than or equal to 0.35 wt. %, optionally greater than or equal to 0.4 wt. %, optionally greater than or equal to 0.45 wt. %, optionally greater than or equal to 0.5 wt. %, optionally greater than or equal to 0.55 wt %, optionally greater than or equal to 0.6 wt. %, optionally greater than or equal to 0.65 wt. %, optionally greater than or equal to 0.7 wt. %, optionally greater than or equal to 0.75 $w^t$.%, optionally greater than or equal to 0.8 wt. %, optionally greater than or equal to 0.85 wt. %, optionally greater than or equal to 0.9 wt. %, and in certain aspects, optionally greater than or equal to 0.95 wt. %, of vanadium. The press hardening steel alloy may include less than or equal to about 1 wt. %, optionally less than or equal to about 0.95 wt. %, optionally less than or equal to about 0.9 wt. %, optionally less than or equal to about 0.85 wt. %, optionally less than or equal to about 0.8 wt. %, optionally less than or equal to about 0.75 wt. %, optionally less than or equal to about 0.7 wt. %, optionally less than or equal to about 0.65 wt. %, optionally less than or equal to about 0.6 wt. %, optionally less than or equal to about 0.55 wt. %, optionally less than or equal to about 0.5 wt. %, optionally less than or equal to about 0.45 wt. %, optionally less than or equal to about 0.4 wt. %, optionally less than or equal to about 0.35 wt. %, optionally less than or equal to about 0.3 wt. %, optionally less than or equal to about 0.25 wt. %, optionally less than or equal to about 0.2 wt. %, optionally less than or equal to about 0.15 wt. %, optionally less than or equal to about 0.1 wt. %, and in certain aspects, optionally less than or equal to about 0.05 wt. %, of vanadium.

In certain variations, the press hardening steel alloys may include greater than or equal to 0 wt. % to less than or equal to about 0.5 wt. % of niobium. For example, the press hardening steel alloys may include greater than or equal to about 0 wt. %, optionally greater than or equal to about 0.02 wt. %, optionally greater than or equal to about 0.04 wt. %, optionally greater than or equal to about 0.06 wt. %, optionally greater than or equal to about 0.08 wt. %, optionally greater than or equal to about 0.1 wt. %, optionally greater than or equal to about 0.12 wt %, optionally greater than or equal to about 0.14 wt. %, optionally greater than or equal to about 0.16 wt. %, optionally greater than or equal to about 0.18 wt. %, optionally greater than or equal to about 0.2 wt. %, optionally greater than or equal to about 0.22 wt. %, optionally greater than or equal to about 0.24 wt. %, optionally greater than or equal to about 0.26 wt. %, optionally greater than or equal to about 0.28 wt. %, optionally greater than or equal to about 0.3 wt. %, optionally greater than or equal to about 0.32 wt. %, optionally greater than or equal to about 0.34 wt. %, optionally greater than or equal to about 0.36 wt. %, optionally greater than or equal to about 0.38 wt. %, optionally greater than or equal to about 0.4 wt. %, optionally greater than or equal to about 0.42 wt. %, optionally greater than or equal to about 0.44 wt. %, optionally greater than or equal to about 0.46 wt. %, and in certain aspects, optionally greater than or equal to about 0.48 wt. %, of niobium. The press hardening steel alloys may include less than or equal to about 0.5 wt. %, optionally less than or equal to about 0.48 wt. %, optionally less than or equal to about 0.46 wt. %, optionally less than or equal to about 0.44 wt. %, optionally less than or equal to about 0.42 wt. %, optionally less than or equal to about 0.4 wt. %, optionally less than or equal to about 0.38 wt. %, optionally less than or equal to about 0.36 wt. %, optionally less than or equal to about 0.34 wt. %, optionally less than or equal to about 0.32 wt. %, optionally less than or equal to about 0.3 wt. %, optionally less than or equal to about 0.28 wt. %, optionally less than or equal to about 0.26 wt. %, optionally less than or equal to about 0.24 wt. %, optionally less than or equal to about 0.22 wt. %, optionally less than or equal to about 0.2 wt. %, optionally less than or equal to about 0.18 wt. %, optionally less than or equal to about 0.16 wt. %, optionally less than or equal to about 0.14 wt. %, optionally less than or equal to about 0.12 wt. %, optionally less than or equal to about 0.1 wt. %, optionally less than or equal to about 0.08 wt. %, optionally less than or equal to about 0.06 wt. %, optionally less than or equal to about 0.04 wt. %, and in certain aspects, optionally less than or equal to about 0.02 wt. %, of niobium.

In each variation, the press hardening steel alloys include a balance of iron. For example, the press hardening steel alloys may include greater than or equal to about 80 wt. %, optionally greater than or equal to about 81 wt. %, optionally greater than or equal to about 82 wt. %, optionally greater than or equal to about 83 wt. %, optionally greater than or equal to about 84 wt. %, optionally greater than or equal to about 85 wt. %, optionally greater than or equal to about 86 wt. %, optionally greater than or equal to about 87 wt. %, optionally greater than or equal to about 88 wt. %, optionally greater than or equal to about 89 wt. %, optionally greater than or equal to about 90 wt. %, optionally greater than or equal to about 91 wt. %, optionally greater than or equal to about 92 wt. %, optionally greater than or equal to about 93 wt. %, optionally greater than or equal to about 94 wt. %, optionally greater than or equal to about 95 wt. %, optionally greater than or equal to about 96 wt. %, optionally greater than or equal to about 97 wt. %, and in certain aspects, optionally greater than or equal to about 98 wt. %, or iron. The skilled artisan will appreciate that the press hardening steel alloys may have a cumulative amount of impurities and contaminants that is at less than or equal to about 0.1 wt. %, optionally less than or equal to about 0.05 wt. %, and in certain variations, less than or equal to about 0.01 wt. %.

The press hardening steel alloys can include certain combinations of carbon, chromium, silicon, manganese, nickel, copper, molybdenum, vanadium, niobium, and/or iron in the above detailed amounts. In certain variations, the press hardening steel alloys may include may consist essentially of: carbon, chromium, silicon, and iron. In other variations, the press hardening steel alloys may consist essentially of carbon, chromium, silicon, manganese, and iron. In still other variations, the press hardening steel alloys may consist essentially of carbon, chromium, silicon, nickel, and iron. In still other variations, the press hardening steel alloys may consist essentially of carbon, chromium, silicon, manganese, nickel, and iron. In still other variations, the press hardening steel alloys may consist essentially of carbon, chromium, silicon, copper, and iron. In still other variations, the press hardening steel alloys may consist essentially of carbon, chromium, silicon, manganese, copper, and iron. In still other variations, the press hardening steel alloys may consist essentially of carbon, chromium, silicon, molybdenum, and iron. In still other variations, the press hardening steel alloys may consist essentially of carbon, chromium, silicon, manganese, molybdenum, and iron. In still other variations, the press hardening steel alloys may consist essentially of carbon, chromium, silicon, vanadium, and iron. In still other variations, the press hardening steel alloys may consist essentially of carbon, chromium, silicon, manganese, vanadium, and iron. In still other variations, the press hardening steel alloys may consist essentially of carbon, chromium, silicon, niobium, and iron. In still other variations, the press hardening steel alloys may consist essentially of carbon, chromium, silicon, manganese, niobium, and iron. In still other variations, the press hardening steel alloys may consist essentially of carbon, chromium, silicon, nickel, copper, molybdenum, vanadium, niobium, and iron. In still other variations, the press hardening steel alloys may consist essentially of carbon, chromium, silicon, manganese, nickel, copper, molybdenum, vanadium, niobium, and iron. In each instance, the term "consists essentially of" indicates that the noted steel alloy excludes only additional compositions, materials, components, elements, and/or features that materially affect the basic and novel characteristics of the steel alloy, such as the steel alloy not requiring coatings or descaling when formed into a press-hardened steel component, but any compositions, materials, components, elements, and/or features that do not materially affect the basic and novel characteristics of the steel alloy can be included in the example embodiment. Further, in certain variations, other elements that are not described herein may also be included in the press hardening steel alloys in trace amounts (e.g., amounts of less than or equal to about 1.5 wt. %, optionally less than or equal to about 1 wt. %, optionally less than or equal to about 0.5 wt. %, or in certain aspects, amounts that are not detectable) provided that those trace materials do not materially affect the basic and novel characteristics of the press hardening steel alloys.

In various aspects, the present disclosure provides methods for forming press-hardening or high-strength steel components from the press hardening steels. The press hardening steels may be in the form of a coil or sheet, and may be free of any applied coating. That is, the press hardening steel does include any layer or coating that is not derived from the steel alloys defining the press hardening steel, nor does the press hardening steel require pre-oxidation prior to process for forming high-strength steel components. However, during forming processes as further detailed below, one or more surfaces of the press hardening steel may react, for example, with atmospheric oxygen, to form one or more dense oxide layers. For example, chromium and/or silicon defining the press-hardening steel may react with atmospheric oxygen to during an initial heating stage (i.e., blank heating) to form the one or more dense oxide layers. The one or more dense oxide layer may prevent or reduce or slow down further oxidation during subsequent heat treatments, including, for example, heat treatments at temperatures greater than about 850° C. The initial heating treatments include, for example, temperatures less than about 850° C. For example, heat treatments may include temperature greater than or equal to about 200° C. to less than about 850° C.

In certain variations, the dense oxide layer may have an average thickness greater than or equal to about 0.1 μm to less than or equal to about 2 μm. For example, the dense oxide layer may have an average thickness greater than or equal to about 0.1 μm, optionally greater than or equal to about 0.2 μm, optionally greater than or equal to about 0.3 μm, optionally greater than or equal to about 0.4 μm, optionally greater than or equal to about 0.5 μm, optionally greater than or equal to about 0.6 μm, optionally greater than or equal to about 0.7 μm, optionally greater than or equal to about 0.8 μm, optionally greater than or equal to about 0.9 m, optionally greater than or equal to about 1 μm, optionally greater than or equal to about 1.1 μm, optionally greater than or equal to about 1.2 μm, optionally greater than or equal to about 1.3 μm, optionally greater than or equal to about 1.4 μm, optionally greater than or equal to about 1.5 μm, optionally greater than or equal to about 1.6 μm, optionally greater than or equal to about 1.7 μm, optionally greater than or equal to about 1.8 μm, and in certain aspects, optionally greater than or equal to about 1.9 μm. The dense oxide layer may have an average thickness less than or equal to about 2 μm, optionally less than or equal to about 1.9 μm, optionally less than or equal to about 1.8 μm, optionally less than or equal to about 1.7 μm, optionally less than or equal to about 1.6 μm, optionally less than or equal to about 1.5 μm, optionally less than or equal to about 1.4 μm, optionally less than or equal to about 1.3 μm, optionally less than or equal to about 1.2 μm, optionally less than or equal to about 1.1 μm, optionally less than or equal to about 1 μm, optionally less than or equal to about 0.9 μm, optionally less than or equal to about 0.8 μm, optionally less than or equal to about 0.7 μm, optionally less than or equal to about 0.6 μm, optionally less than or equal to about 0.5 μm, optionally less than or equal to about 0.4 μm, optionally less than or equal to about 0.3 μm, and in certain aspects, optionally less than or equal to about 0.2 μm.

FIG. 1 illustrates an example method 10 for forming press-hardening steel components. The method 10 include obtaining a press hardening steel 12, for example, in the form of a coil or sheet, and uncoiling and/or cutting the press hardening steel 12 to form a plurality of blanks 14. The method 10 further includes hot pressing the blank 14. In certain variations, hot pressing includes austenitizing the blanks, for example, by heating the blanks 14 above an upper critical temperature (Ac3) identified for the steel alloy defining the blanks 14. The blanks 14 may be heated using a roller hearth furnace 16. In certain variations, as illustrated in FIG. 2, the roller hearth furnace 16 includes plurality of zones, where zones downstream have temperatures that are greater than temperatures of zones upstream, such that blanks 14 have lower heating rates while traveling through earlier zones as compared to heating rates in later zones.

For example, in certain variations, the plurality of zones includes a first zone 100 located, for example, near an entrance to the roller hearth furnace 16. The first zone 100 may have a first temperature. The first temperature may be greater than or equal to about 700° C. to less than about 800° C. The blank 14 is held at the first temperature for a period greater than or equal to about 39 seconds to less than or equal to about 59 seconds. In further variations, the plurality of zones further includes a second zone 110. The second zone 110 may be located downstream of the first zone 110. The second zone 110 may have a second temperature that is greater than the first temperature. For example, the second temperature may be greater than about 800° C. to less than or equal to about 850° C. The blank 14 is held at the second temperature for a period greater than or equal to about 13 seconds to less than or equal to about 29 seconds. In further variations, the plurality of zones further includes a third zone 120. The third zone 120 may be located downstream of the second zone 110. The third zone may have a third temperature that is greater than the second temperature. For example, the third temperature may be greater than or equal to about 850° C. to less than or equal to about 880° C., and in certain aspects, optionally about 910° C. The blank 14 is held at the third temperature for a period greater than or equal to about 29 seconds to less than or equal to about 47 seconds.

In further variations, the plurality of zones further includes a fourth zone 130. The fourth zone 130 may be located downstream of the third zone 120. The fourth zone 130 may have a fourth temperature that is greater than the third temperature. For example, the fourth temperature may be greater than or equal to about 910° C. to less than or equal to about 930° C. and in certain aspects, optionally about 930° C. The blank 14 is held at the fourth temperature for a period greater than or equal to about 35 seconds to less than or equal to about 50 seconds. In still further variations, the plurality of zones further includes a fifth zone 140. The fifth zone 140 may be located downstream of the fourth zone 130. The fifth zone 140 may have a fifth temperature that is the same as or different from the fourth temperature. For example, the fifth temperature may be greater than or equal to about 930° C. to less than or equal to about 950° C. and in certain aspects, optionally about 930° C. The blank 14 is held at the fifth temperature for a period greater than or equal to about 20 seconds to less than or equal to about 50 seconds. In other variations, the plurality of zones further includes a sixth zone 150. The sixth zone 150 may be located downstream of the fifth zone 140. The sixth zone 150 may have a sixth temperature that is the same as or different form the fifth temperature. For example, the sixth temperature may be greater than or equal to about 930° C. to less than or equal to about 950° C., and in certain aspects, optionally about 930° C. The blank 14 is held at the sixth temperature for a period greater than or equal to about 30 seconds to less than or equal to about 50 seconds.

Protective gases, for example, nitrogen-containing gases, are circulated as the blanks 14 move through the roller hearth furnace 16. In certain variations, the nitrogen-containing gases may be an inert gas, such as a $N_2$ gas blanket. In each variation, the plurality of zones may have different flow rates for the nitrogen-containing gases. For example, the first zone 100 and/or second zone 110 may have a first flow rate for the nitrogen-containing gases, while downstream zones (like the third zone 120 and/or the fourth zone 130 and/or the fifth zone 140 and/or the sixth zone 150) may have a second flow rate for the nitrogen-containing gases that is greater than the first flow rate. In certain variations, the first flow rate may be greater than or equal to about 30 $m^3$/hour (h) to less than or equal to about 50 $m^3$/h. The second flow rate may be greater than or equal to about 160 $m^3$/h. The reduced flow rate in the earlier zones increases the available oxygen, thereby promoting the formation of the one or more dense oxide layers.

Although six total zones are illustrated, the skilled artisan will appreciate that the plurality of zones may include fewer or additional zones, where downstream zones generally have higher temperature than upstream zones, and in particular, early upstream zones. Moreover, although not illustrated, the skilled artisan will understand that the roller hearth furnace 16 includes a plurality of rollers that moves the blanks 14 between the plurality of zones.

With renewed reference to FIG. 1, the method 10 may further include stamping the heated blank using, for example, a die or press 18, to form a structure having a predetermined shape (i.e., the press-harden steel component) 20. In certain variations, the stamping process includes applying a pressure greater than or equal to about 1 MPa to less than or equal to about 25 MPa using the die or press 18. The stamping process may also include, while the heated blank is disposed in the die or press 18, quenching the heated blank, for example, at a constant rate, to a temperature that is less than or equal to about a martensite finish (Mf) temperature of the steel alloy defining the press hardening steel 12 and greater than or equal to about room temperature (i.e., greater than or equal to about 20° C. to less than or equal to about 22° C.). In certain variations, the quenching may occur at a constant rate of greater than or equal to about 20° C./s. Although not illustrated, it should be understood that the heated black can be transferred to the die or press 18 using a robotic arm.

FIG. 3 is a graphical illustration that further details the example method 10 for forming press-hardening steel components, where the x-axis 200 represents time, the y-axis 202 represents temperature, line 210 represents room temperature, line 220 represents the upper critical temperature (Ac3) identified for the steel alloy defining the blanks 14, and the plurality of zones, as detailed above, are identified. In certain variations, materials in the first zone 100 may have a first heating rate greater than or equal to about 10° C./s to less than or equal to about 30° C./s; materials in the second zone 110 may have a second heating rate greater than or equal to about 10° C./s to less than or equal to about 30° C./s; materials in the third zone 120 may have a third heating rate greater than or equal to about 3° C./s to less than or equal to about 20° C./s; materials in the fourth zone 130 may have a fourth heating rate greater than or equal to about 1° C./s to less than or equal to about 10° C./s; materials in the fifth zone 150 may have a fifth heating rate greater than or equal to about 0° C./s to less than or equal to about 5° C./s; and materials in the sixth zone 160 may have a sixth heating rate greater than or equal to about 0° C./s to less than or equal to about 5° C./s.

The as-prepared press-hardening steel components may have a microstructure including martensite, dispersed carbides and retained austenite. The microstructure may also include some small amount (e.g., less than 2% as measured in volume fraction) of ferrite or bainite.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method for preparing a press-hardened steel component, the method comprising:

austenitizing a steel alloy blank to form a heated blank using a furnace having two or more zones, a first zone of the two or more zones having a first temperature and a first flow rate for a protective gas, a second zone of the two or more zones having a second temperature that is greater than the first temperature and a second flow rate for the protective gas that is greater than the first flow rate, a first heating rate in the first zone being greater than or equal to about 10° C./second to less than or equal to about 30° C./second, and a second heating rate in the second zone being greater than or equal to about 0° C./second to less than or equal to about 10° C./second; and stamping the heated blank to form a predetermined shape that defines the press-hardened steel component.

2. The method of claim 1, wherein the first temperature is greater than or equal to about 700° C. to less than or equal to about 910° C., and the second temperature is greater than or equal to about 760° C. to less than or equal to about 950° C.

3. The method of claim 1, wherein the first flow rate is greater than or equal to about 30 $m^3$/h to less than or equal to about 50 $m^3$/hour, and the second flow rate is greater than or equal to about 50 $m^3$/hour to less than or equal to about 160 $m^3$/hour.

4. The method of claim 1, wherein the steel alloy blank is held in the first zone for a period greater than or equal to about 39 seconds to less than or equal to about 164 seconds.

5. The method of claim 1, wherein the protective gas is a nitrogen-containing gas.

6. The method of claim 1, wherein the steel alloy blank comprises:

greater than or equal to about 0.05 wt. % to less than or equal to about 0.45 wt. % of carbon (C);

greater than or equal to about 0.5 wt. % to less than or equal to about 6 wt. % of chromium (Cr);

greater than or equal to about 0.5 wt. % to less than or equal to about 2.5 wt. % of silicon (Si); and a balance of iron.

7. The method of claim 6, wherein the steel alloy blank further comprises:

greater than 0 wt. % to less than or equal to about 4.5 wt. % of manganese (Mn).

8. The method of claim 6, wherein the steel alloy blank further comprises at least one of:

greater than 0 wt. % to less than or equal to about 5 wt. % of nickel (Ni);

greater than 0 wt. % to less than or equal to about 3 wt. % of copper (Cu);

greater than 0 wt. % to less than or equal to about 1 wt. % of molybdenum (Mo);

greater than 0 wt. % to less than or equal to about 1 wt. % of vanadium (V); and greater than 0 wt. % to less than or equal to about 0.5 wt. % of niobium (Nb).

9. The method of claim 1, wherein the stamping comprises:

quenching the heated blank at a constant rate to a temperature less than or equal to about a martensite finish (Mf) temperature of the steel alloy defining the steel alloy blank and greater than or equal to about 20° C.

10. A method for preparing a press-hardened steel component, the method comprising:

austenitizing a steel alloy blank to form a heated blank using a furnace having two or more zones, wherein a first zone of the two or more zones has a first temperature greater than or equal to about 700° C. to less than or equal to about 910° C. and a first flow rate for a protective gas, and a second zone of the two or more zones has a second temperature that is greater than the first temperature and a second flow rate for the protective gas that is greater than the first flow rate, the second temperature being greater than or equal to about 760° C. to less than or equal to about 950° C.; and stamping the heated blank to form a predetermined shape that defines the press-hardened steel component.

11. The method of claim 10, wherein the first flow rate is greater than or equal to about 30 $m^3$/h to less than or equal to about 50 $m^3$/hour, and the second flow rate is greater than or equal to about 50 $m^3$/hour to less than or equal to about 160 $m^3$/hour.

12. The method of claim 10, wherein the steel alloy blank is held in the first zone for a period greater than or equal to about 39 seconds to less than or equal to about 164 seconds.

13. The method of claim 10, wherein the protective gas is a nitrogen-containing gas.

14. The method of claim 10, wherein the steel alloy blank comprises:

greater than or equal to about 0.05 wt. % to less than or equal to about 0.45 wt. % of carbon (C);

greater than or equal to about 0.5 wt. % to less than or equal to about 6 wt. % of chromium (Cr);

greater than or equal to about 0.5 wt. % to less than or equal to about 2.5 wt. % of silicon (Si);

greater than or equal to 0 wt. % to less than or equal to about 4.5 wt. % of manganese (Mn);

greater than or equal to 0 wt. % to less than or equal to about 5 wt. % of nickel (Ni);

greater than or equal to 0 wt. % to less than or equal to about 3 wt. % of copper (Cu);

greater than or equal to 0 wt. % to less than or equal to about 1 wt. % of molybdenum (Mo);

greater than or equal to 0 wt. % to less than or equal to about 1 wt. % of vanadium (V);

greater than or equal to 0 wt. % to less than or equal to about 0.5 wt. % of niobium (Nb); and a balance of iron.

15. The method of claim 10, wherein the stamping comprises:

quenching the heated blank at a constant rate to a temperature less than or equal to about a martensite finish (Mf) temperature of the steel alloy defining the steel alloy blank and greater than or equal to about 20° C.

16. A method for preparing a press-hardened steel component, the method comprising:

austenitizing a steel alloy blank to form a heated blank using a furnace having two or more zones, wherein a first zone of the two or more zones has a first temperature and a first flow rate for a protective gas, and a second zone of the two or more zones has a second temperature that is greater than the first temperature and a second flow rate for the protective gas that is greater than the first flow rate; and stamping the heated blank to form a predetermined shape that defines the press-hardened steel component, the stamping comprising quenching the heated blank at a constant rate to a temperature less than or equal to about a martensite finish (Mf) temperature of the steel alloy defining the steel alloy blank and greater than or equal to about 20° C.

17. The method of claim 16, wherein the first flow rate is greater than or equal to about 30 $m^3$/h to less than or equal to about 50 $m^3$/hour, and the second flow rate is greater than or equal to about 50 $m^3$/hour to less than or equal to about 160 $m^3$/hour.

18. The method of claim 16, wherein the steel alloy blank is held in the first zone for a period greater than or equal to about 39 seconds to less than or equal to about 164 seconds.

19. The method of claim 16, wherein the protective gas is a nitrogen-containing gas.

20. The method of claim 16, wherein the steel alloy blank comprises:

greater than or equal to about 0.05 wt. % to less than or equal to about 0.45 wt. % of carbon (C);

greater than or equal to about 0.5 wt. % to less than or equal to about 6 wt. % of chromium (Cr);

greater than or equal to about 0.5 wt. % to less than or equal to about 2.5 wt. % of silicon (Si);

greater than or equal to 0 wt. % to less than or equal to about 4.5 wt. % of manganese (Mn);

greater than or equal to 0 wt. % to less than or equal to about 5 wt. % of nickel (Ni);

greater than or equal to 0 wt. % to less than or equal to about 3 wt. % of copper (Cu);

greater than or equal to 0 wt. % to less than or equal to about 1 wt. % of molybdenum (Mo);

greater than or equal to 0 wt. % to less than or equal to about 1 wt. % of vanadium (V);

greater than or equal to 0 wt. % to less than or equal to about 0.5 wt. % of niobium (Nb); and a balance of iron.

* * * * *